US006499014B1

(12) United States Patent
Chihara

(10) Patent No.: US 6,499,014 B1
(45) Date of Patent: Dec. 24, 2002

(54) SPEECH SYNTHESIS APPARATUS

(75) Inventor: Keiichi Chihara, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/521,449

(22) Filed: Mar. 7, 2000

(30) Foreign Application Priority Data

Apr. 23, 1999 (JP) ..... 11-116272

(51) Int. Cl.[7] ..... G10L 13/00; G10L 13/06; G10L 13/08

(52) U.S. Cl. ..... 704/260; 704/267; 704/268

(58) Field of Search ..... 704/258, 260, 704/264, 266, 267, 268, 269

(56) References Cited

U.S. PATENT DOCUMENTS

| | | | | |
|---|---|---|---|---|
| 4,907,279 A | * | 3/1990 | Higuchi et al. | 704/260 |
| 5,463,713 A | * | 10/1995 | Hasegawa | 704/258 |
| 5,475,796 A | * | 12/1995 | Iwata | 704/254 |
| 5,758,320 A | * | 5/1998 | Asano | 704/258 |
| 5,950,152 A | * | 9/1999 | Arai et al. | 704/200 |

FOREIGN PATENT DOCUMENTS

JP 11095796 4/1999

OTHER PUBLICATIONS

Fujisaki et al., "Realization of Linguistic Information in the Voice Fundamental Frequency Contour of the Spoken Japanese," ICASSP–8 International Conference on Acoustics, Speech, and Signal Processing, Apr. 1988, vol. 1, pp. 663 to 666.*

"Chatr: a multi–lingual speech re–sequencing synthesis system" Campbell et al., Technical Report of IEICE SP96–7 (May 1999) pp. 45–52.

* cited by examiner

*Primary Examiner*—Tālivaldis Ivars Šmits
*Assistant Examiner*—Martin Lerner
(74) *Attorney, Agent, or Firm*—Michael A. Sartori; Venable

(57) ABSTRACT

The speech synthesis apparatus of the present invention includes: a text analyzer operable to generate a phonetic and prosodic symbol string from character information of an input text; a word dictionary storing a reading and an accent of a word; an voice segment dictionary storing a phoneme that is a basic unit of speech; a parameter generator operable to generate synthesizing parameters including at least a phoneme, a duration of the phoneme and a fundamental frequency for the phonetic and prosodic symbol string, the parameter generator including a calculating means operable to obtain a sum of phrase components and a sum of accent components and to calculate an average pitch from the sum of the phrase components and the sum of the accent components, and a determining means operable to determine a base pitch from the average pitch; and a waveform generator operable to generate a synthesized waveform by making waveform-overlapping referring to the synthesizing parameters generated by the parameter generator and the voice segment dictionary.

4 Claims, 15 Drawing Sheets

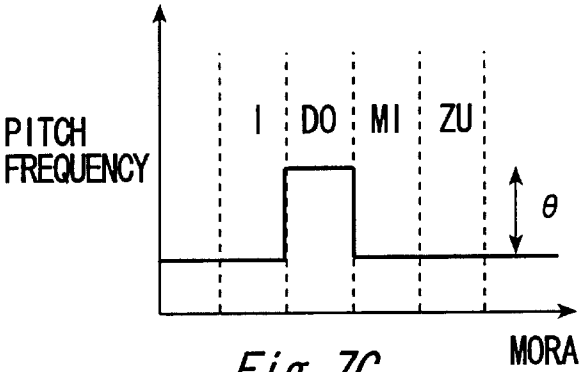
Fig. 7C
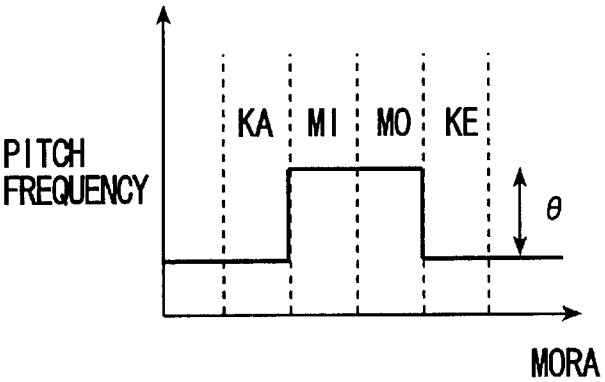
Fig. 7D
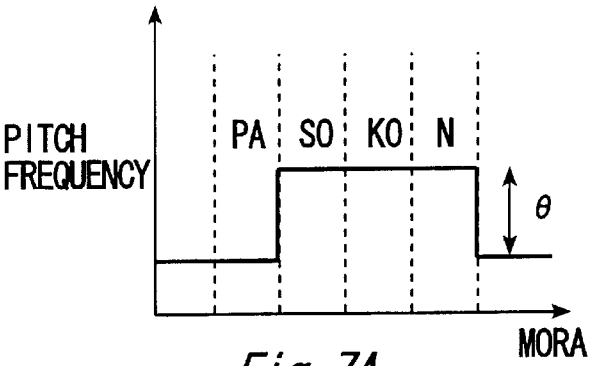
Fig. 7A
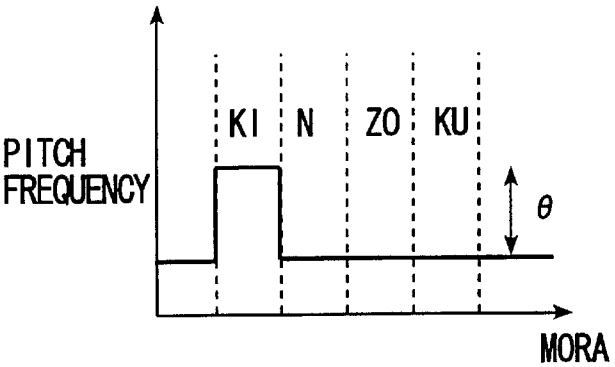
Fig. 7B
Fig. 7

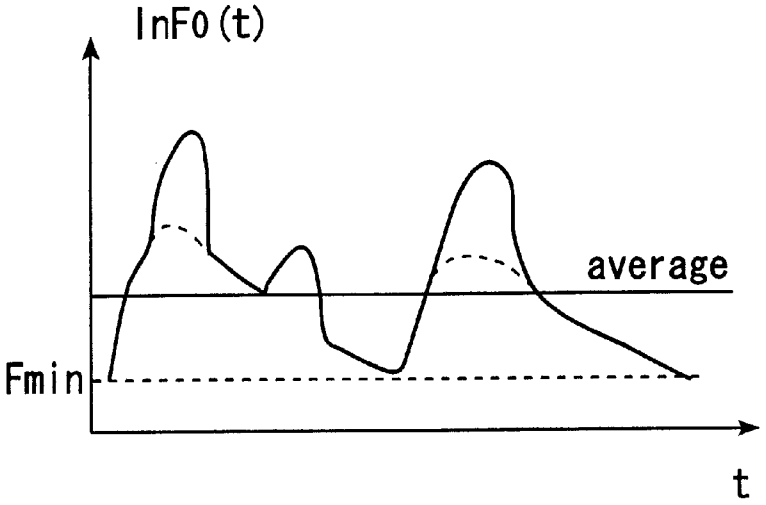
Fig. 15B
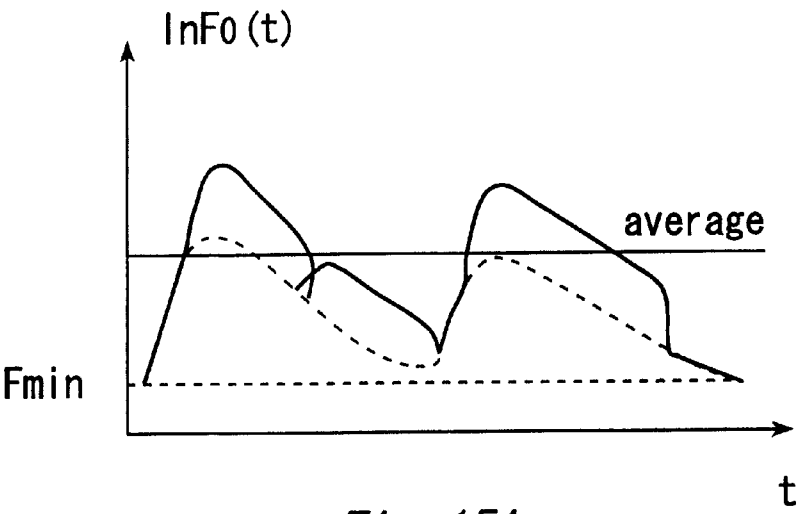
Fig. 15A
PRIOR ART
Fig. 15

SPEECH SYNTHESIS APPARATUS

BACKGROUND OF THE INVENTION

1. Field of the Invention

The present invention relates to a speech synthesis apparatus that synthesizes a given speech by rules, in particular to a speech synthesis apparatus in which control of pitch contour of synthesized speech is improved in a text-to-speech conversion technique that outputs a mixed sentence including Chinese characters (called Kanji) and Japanese syllabary (Kana) used in our daily reading and writing, as the speech.

2. Description of the Related Art

According to the text-to-speech conversion technique, Kanji and Kana characters used in our daily reading and writing are input and converted into speech in order to be output. This technique has no limitation on the vocabulary to be output. Thus, the text-to-speech conversion technique is expected to be applied to various technical fields as an alternative technique to recording-reproducing speech synthesis.

When Kanji and Kana characters (hereinafter, referred to as a text) are input to a conventional speech synthesis apparatus, a text analysis module included therein generates a string of phonetic and prosodic symbols (hereinafter, referred to as an intermediate language) from the character information. The intermediate language describes how to read the input sentence, accents, intonation and the like as a character string. A prosody generation module then determines synthesizing parameters from the intermediate language generated by the text analysis module. The synthesizing parameters include a pattern of a phoneme, a duration of the phoneme and a fundamental frequency (pitch of voice, hereinafter simply referred to as pitch) and the like. The determined synthesizing parameters are output to a speech generation module. The speech generation module generates a synthesized waveform generated in the prosody generation module and a voice segment dictionary in which phonemes are accumulated, and then outputs synthetic sound through a speaker.

Next, a conventional process conducted by the prosody generation module is described in detail. The conventional prosody generation module includes an intermediate language analysis module, a phrase command determination module, an accent command determination module, a phoneme duration calculation module, a phoneme power determination module and a pitch contour generation module.

The intermediate language input to the prosody generation module is a string of phonetic characters with the position of an accent, the position of a pause or the like. From this string, parameters required for generating a waveform (hereinafter, referred to as waveform-generating parameters), such as time-variant change of the pitch (hereinafter, referred to as a pitch contour), the duration of each phoneme (hereinafter, referred to as the phoneme duration), and power of speech are determined. The intermediate language input is subjected to analysis of the character string in the intermediate language analysis module. In the analysis, word-boundaries are determined based on a symbol indicating a word's end in the intermediate language, and a mora position of an accent nucleus is obtained based on an accent symbol.

The accent nucleus is a position at which the accent falls. A word having an accent nucleus positioned at the first mora is referred to as a word of accent type one while a word having an accent nucleus positioned at the n-th mora is referred to as a word of accent type n. These words are referred to an accented word. On the other hand, a word having no accent nucleus (for example, "shin-bun" and "pasokon", which mean a newspaper and a personal computer in Japanese, respectively) are referred to as a word of accent type zero or an unaccented word.

The phrase command determination module and the accent command determination module determine parameters for response functions described later, based on a phrase symbol, an accent symbol and the like in the intermediate language. In addition, if a user sets intonation (the magnitude of the intonation), the magnitude of the phrase command and that of the accent command are modified in accordance with the user's setting.

The phoneme duration calculation module determines the duration of each phoneme from the phonetic character string and sends the calculation result to the speech generation module. The phoneme duration is calculated using rules or a statistical analysis such as Quantification theory (type one), depending on the type of an adjacent phoneme. Quantification theory (type one) is a kind of factor analysis, and it can formulate the relationship between categorical and numerical values. In addition, in the case where the user sets a speech rate, the phoneme duration determination module is influenced by the speech rate. Normally, the phoneme duration becomes longer when the speech rate is made slower, while the phoneme duration becomes shorter when the speech rate is made faster.

The phoneme power determination module calculates the value of the amplitude of the waveform in order to send the calculated value to the speech generation module. The phoneme power is a power transition in a period corresponding to a rising portion of the phoneme in which the amplitude gradually increases, in a period corresponding to a steady state, and in a period corresponding to a falling portion of the phoneme in which the amplitude gradually decreases, and is calculated based on coefficient values in the form of a table.

These waveform generating parameters are sent to the speech generation module. Then, the synthesized waveform is generated.

Next, a procedure for generating a pitch contour in the pitch contour generation module is described.

FIG. 14 is a diagram explaining the generation procedure of the pitch contour and illustrates a model of a pitch control mechanism.

In order to sufficiently represent differences of intonation between various sentences, it is necessary to clarify the relationship between pitch and time in a syllable. The "pitch control mechanism model" described by a critical damping second-order linear system is used as a model that can clearly describe the pitch contour in the syllable and can define the time-variant structure of the syllable. The pitch control mechanism model described in the present specification is the model explained below.

The pitch control mechanism model is a model that is considered to generate a fundamental frequency providing information about the voice pitch. The frequency of vibration of vocal cords, that is, the find a mental frequency, is controlled by an impulse command generated at every change of phrase, and a stepwise command generated at every rising and falling of an accent. Because of delay characteristics of physiological mechanisms, the impulse command of the phrase is a curve (phrase component)

gradually descending from the front of a sentence to the end of the sentence, (see the waveform indicated with a broken line in FIG. 14), while the stepwise command of the accent is a curve (accent component) with local ups and downs, (indicated by a waveform with a solid line in FIG. 14). Each of these two components are modeled as a response of the critical damping second-order linear system of the corresponding command. The pattern of the time-variant change of the logarithmic fundamental frequency is expressed as a sum of these two components.

The logarithmic fundamental frequency F0(t) (t: time) is formulated as shown by Expression (1).

$$\mathrm{Ln}F0(t) = \ln Fmin + \sum_{i=1}^{I} ApiGpi(t - T0i) + \sum_{j=1}^{J} Aaj\{Gaj(t - T1j) - Gaj(t - T2j)\} \quad (1)$$

In Expression (1), Fmin is the lowest frequency (hereinafter, referred to as a base pitch), I is the number of phrase commands in the sentence, Api is the magnitude of the i-th phrase command in the sentence, T0i is a start time of the i-th phrase command in the sentence, J is the number of accent commands in the sentence, Aaj is the magnitude of the j-th accent command in the sentence, and T1j and T2j are a start time and an end time of the j-th accent command, respectively. Gpi(t) and Gaj(t) are an impulse response function of the phrase control mechanism and a step response function of the accent control mechanism given by Expressions (2) and (3), respectively.

$$Gpi(t)=\alpha i^2 t\exp(-\alpha it) \quad (2)$$

$$Gaj(t)=\min[1-(1+\beta jt)\exp(-\beta jt), \theta] \quad (3)$$

Expressions (2) and (3) are the response functions when $t \geqq 0$; and when $t<0$, Gpi(t)=Gaj (t)=0. In addition, min [x, y] in Expression (3) means either one value of x and y that is smaller than the other. This corresponds to the fact that in actual speech, the accent component reaches an upper limit thereof within a finite time period. In the above, $\alpha i$ is a natural angular frequency of the phrase control mechanism for the i-th phrase command, and is set to 3.0, for example. $\beta j$ is a natural angular frequency of the accent control mechanism for the j-th accent command, and is set to 20.0, for example. $\theta$ is the upper limit of the accent component and is selected to be 0.9, for example.

The fundamental frequency and the pitch controlling parameters (Api, Aaj, T0i, T1j, T2j, $\alpha i$, $\beta j$ and Fmin) are defined as follows. [Hz] is used as a unit for F0(t) and Fmin; [sec] is used for T0i, T1j and T2j; and [rad/sec] is used for $\alpha i$ and $\beta j$. For Api and Aaj, values obtained when the units for the fundamental frequency and the pitch controlling parameters are defined as mentioned above are used.

In accordance with the generation procedure described above, the prosody generation module determines the pitch controlling parameters from the intermediate language. For example, the creation time T0i of the phrase command is set at a position where punctuation in the intermediate language exists; the start time T1j of the accent command is set at a position immediately after a word-boundary symbol; and the end time T2j of the accent command is set at a position where the accent symbol exists or at a position immediately before a symbol indicating a boundary between the word in question and the next word in a case where the word in question is an even accent word having no accent symbol.

Api and Aaj, indicating the magnitudes of the phrase command and the accent command, respectively are obtained as quantized values normally by text analysis, each having any of three levels. Thus, Api and Aaj are defined depending on the types of the phrase symbol and the accent symbol in the intermediate language. In some recent cases, the magnitudes of the phrase command and the accent command are not determined by rules, but are determined using a statistical analysis such as Quantification theory (type one). In a case where a user sets the intonation, the determined values Api and Aaj are modified.

Normally, the set intonation is controlled to be any of 3 to 5 levels by being multiplied by a constant value previously assigned to each level. In a case where the intonation is not set, the modification is not performed.

The base pitch Fmin expresses the lowest pitch of the synthesized speech and is used for controlling the voice pitch. Normally, Fmin is quantized into any of 5 to 10 levels and is stored in the form of a table. Fmin is increased when high-pitch voice is preferred, or is decreased when low-pitch voice is preferred, depending on the user's preference. Therefore, Fmin is modified only when the user sets the value. The modifying process is performed in the pitch contour generation module.

The conventional pitch contour generating method mentioned above had a serious problem where the average pitch fluctuates to a large degree depending on the word-structure of the input text to be synthesized. The problem is explained below.

FIGS. 15A and 15B are diagrams illustrating a comparison of pitch contours having different accent types. When the pitch contours shown in FIGS. 15A and 15B are compared to each other, the average pitch in a text including successive unaccented words (FIG. 15A) is clearly different from that in a text including successive accented words (FIG. 15B). When a person recognizes the voice pitch, it is considered that the person relies on the average pitch, not on the base pitch. In many cases, the text-to-speech conversion technique is used not for the speech synthesis of a single sentence, but for the speech synthesis of a composite sentence. Therefore, there was a problem where the speech was hard to hear because the voice pitch raises or falls in some sentences, according to the conventional method.

Moreover, the user's setting of the intonation is realized by multiplying the magnitudes of the phrase command and the accent command obtained by a predetermined procedure by a certain constant value. Therefore, in a case where the intonation is increased, it is likely that the voice pitch becomes in part extremely high in a certain sentence. Such synthesized speech is hard to hear and has a bias in tones. When such synthesized speech is heard, the part of the speech with a degraded quality is likely to remain in the ears.

SUMMARY OF THE INVENTION

It is an object of the present invention to provide a speech synthesis apparatus that can produce synthesized speech that is easy to hear, with fluctuation of the average pitch between sentences suppressed.

It is another object of the present invention to provide a speech synthesis apparatus that can prevent the voice pitch from being extremely high and can produce synthesized speech that is easy to hear.

According to an aspect of the present invention , a speech synthesis apparatus includes: a text analyzer operable to generate a phonetic and prosodic symbol string from character information of an input text; a word dictionary storing a reading and an accent of a word; a voice segment dictionary storing a phoneme that is a basic unit of speech; a parameter generator operable to generate synthesizing parameters including at least a phoneme, a duration of the phoneme and a fundamental frequency for the phonetic and prosodic symbol string, the parameter generator including a calculating means operable to obtain a sum of phrase components and a sum of accent components and to calculate an average pitch from the sum of the phrase components and the sum of the accent components, and a determining means operable to determine a base pitch from the average pitch; and a waveform generator operable to generate a synthesized waveform by making waveform-overlapping referring to the synthesizing parameters generated by the parameter generator and the voice segment dictionary.

In one embodiment of the present invention, the calculating means calculates an average value of the sum of the phrase commands and the sum of the accent commands as the average pitch. This calculation is undertaken based on creation times and magnitudes of the respective phrase commands, start times, end times and magnitudes of the respective accent commands. The determining means determines the base pitch in such a manner that a value obtained by adding the average value and the base pitch becomes constant.

According to another aspect of the present invention, a speech synthesis apparatus includes: a text analyzer operable to generate a phonetic and prosodic symbol string from character information of an input text; a word dictionary storing a reading and an accent of a word; a voice segment dictionary storing a phoneme that is a basic unit of speech; a parameter generator operable to generate synthesizing parameters including at least a phoneme, a duration of the phoneme and a fundamental frequency for the phonetic and prosodic symbol string, the parameter generator including a calculating means operable to overlap a phrase component and an accent component, obtain an approximation of a pitch contour from the overlapped phrase and accent components and calculate at least a maximum value of the approximation of the pitch contour, and a modifying means operable to modify a value of the phrase component and a value of the accent component by using at least the maximum value; and a waveform generator operable to generate a synthesized waveform by making waveform-overlapping referring to the synthesizing parameters generated by the parameter generator and the voice segment dictionary.

In one embodiment of the present invention, the calculating means calculates a maximum value and a minimum value of the pitch contour from a creation time and a magnitude of the phrase command and a start time, an end time and a magnitude of the accent command. The modifying means modifies the magnitude of the phrase component and the magnitude of the accent component in such a manner that the difference between the maximum value and the minimum value is made substantially the same as the intonation value set by a user.

BRIEF DESCRIPTION OF THE DRAWINGS

FIGS. 7A to 7D are diagrams showing a simple comparison of pitch contours of words having different accent types.

FIG. 15 is a diagram showing a comparison of pitch contours having different accent types.

DETAILED DESCRIPTION OF PREFERRED EMBODIMENTS

Hereinafter, the present invention will be described with reference to preferred embodiments thereof. However, it should be noted that the claimed invention is not limited to the embodiments described below nor are all combinations of the features recited in the embodiments described below necessary for solving the above-described problems.

Figure 1:
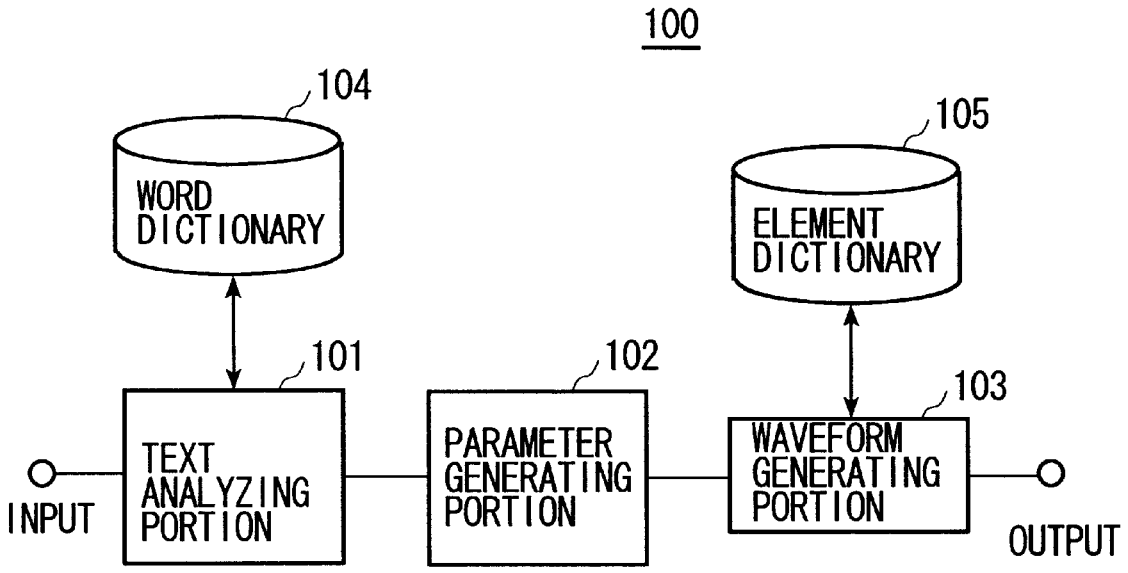
FIG. 1 is a block diagram schematically showing an entire structure of a speech synthesis apparatus according to the present invention.

FIG. 1 is a functional block diagram showing an entire structure of a speech synthesis apparatus 100 according to the present invention. As shown in FIG. 1, the speech synthesis apparatus 100 includes a text analysis module 101, a prosody generation module 102, a speech generation module 103, a word dictionary 104 and a voice segment dictionary 105. When text including Kanji and Kana characters is input to the text analysis module 101, the text analysis module 101 determines the reading, accent and intonation by referring to the word dictionary 104, in order to output a string of phonetic symbols with prosodic symbols. The prosody generation module 102 sets a pattern of pitch frequency, phoneme duration and the like, and the speech generation module 103 performs the speech synthesis process. The speech generation module 103 refers to speech data accumulated and selects one or more speech synthesis units from a target phonetic series. Then, the speech generation module 103 combines/modifies the selected speech synthesis units in accordance with the parameters determined in the prosody generation module 102 so as to perform the speech synthesis.

As the speech synthesis unit, a phoneme, a syllable CV, VCV unit and CVC unit (where C denotes a consonant and V denotes a vowel), a unit obtained by extending a phonetic chain and the like are known.

As a means of speech synthesis, a synthesis method is known in which a speech wavelength is marked with pitch marks (reference points) in advance. Then, a part of the waveform around the pitch mark is extracted. In the waveform synthesis, the extracted waveform is shifted in order to shift the pitch mark by a distance corresponding to a synthesizing pitch, and is then overlap-added with the shifted waveform.

In order to output more natural synthesized speech by means of a speech synthesis apparatus having the above structure, a manner of extracting the unit of the phoneme, the quality of the phoneme and a speech synthesis method are extremely important. In addition to these factors, it is important to appropriately control parameters (the pitch frequency pattern, the length of the phoneme duration, the length of a pause, and the amplitude) in the prosody generation module 102 in order to be close to those appearing in the natural speech. Here, the pause is a period of a pause appearing before and after a clause.

When text is input to the text analysis module 101, the text analysis module 101 generates a string of the phonetic and prosodic symbols (the intermediate language) from the character information. The phonetic and prosodic symbol string is a string in which the reading of the input sentence, the accents, the intonation and the like are described as a string of characters. The word dictionary 104 is a pronunciation dictionary in which readings and accents of words are stored. The text analysis module 101 refers to the word dictionary 104 when generating the intermediate language.

The prosody generation module 102 determines the synthesizing parameters including patterns such as a phoneme, a duration of the phoneme, a pitch and the like from the intermediate language generated by the text analysis module 101, and then outputs the determined parameters to the speech generation module 103. The phoneme is a basic unit of speech that is used for producing the synthesized waveform. The synthesized waveform is obtained by connecting one or more phonemes. There are various phonemes depending on types of sound.

The speech generation module 103 generates the synthesized waveform based on the parameters generated by the prosody generation module 102 with reference to the voice segment-dictionary 105 which stores the phonemes and the like generated by the speech generation module 103. The synthesized speech is output via a speaker (not shown).

Figure 2:
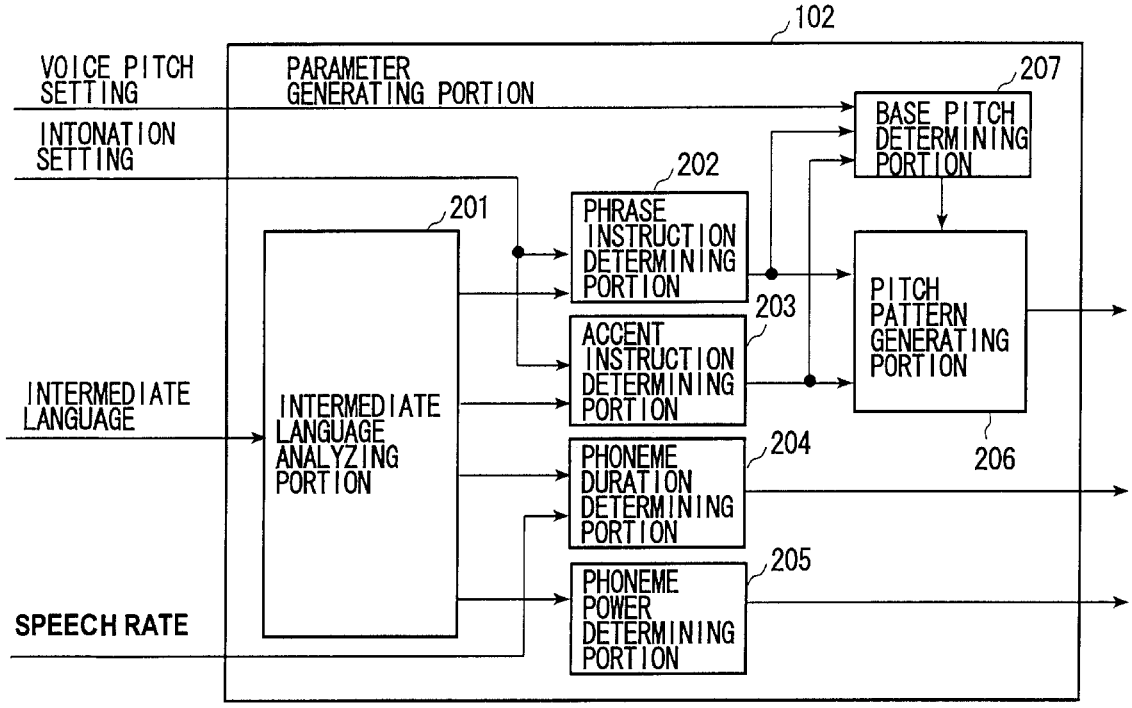
FIG. 2 is a block diagram schematically showing a structure of a prosody generation module according to a first embodiment of the present invention.

FIG. 2 is a block diagram schematically showing a structure of the prosody generation module of the speech synthesis apparatus according to the first embodiment of the present invention. The main features of the present invention relate to how to generate a pitch contour in the prosody generation module 102. As shown in FIG. 2, the prosody generation module 102 includes an intermediate language analysis module 201, a phrase command determination module 202, an accent command determination module 203, a phoneme duration calculation module 204, a phoneme power determination module 205, a pitch contour generation module 206 and a base pitch determination module 207 (a calculating means and a determining means).

The intermediate language in which the prosodic symbols are added is input to the prosody generation module 102. Voice parameters such as pitch of voice, magnitude of intonation, or speech rate may be set externally, depending on the user's preference and the usage.

The intermediate language is input to the intermediate language analysis module 201 and is then subjected to analysis of phonetic symbols, word-end symbols, accent symbols and the like so as to be converted to necessary parameters. The parameters are output to the phrase command determination module 202, the accent command determination module 203, the phoneme duration determination module 204 and the phoneme power determination module 205, respectively. The parameters will be described in detail later.

The phrase command determination module 202 calculates a creation time T0i and a magnitude Api of a phrase command from the input parameters and the intonation set by the user. The calculated creation time T0i and the magnitude Api of the phrase command are output to the pitch contour generation module 206 and the base pitch determination module 207.

The accent command determination module 203 calculates a start time T1j, an end time T2j and a magnitude Aaj of the accent command from the input parameters and the intonation set by the user. The calculated start time T1j, the end time T2j and the magnitude Aaj of the accent command are output to the pitch contour generation module 206 and the base pitch determination module 207.

The phoneme duration calculation module 204 calculates the duration of each phoneme from the input parameters and outputs it to the speech generation module 103. If the user sets a speech rate, the speech rate set by the user is input to the phoneme duration determination module 204, resulting in output of the phoneme duration obtained by taking the value of the set speech rate into consideration.

The phoneme power determination module 205 calculates an amplitude shape of each phoneme from the input parameters and outputs it to the speech generation module 103.

The base pitch determination module 207 calculates the base pitch Fmin from the parameters output from the phrase command determination module 202 and the accent command determination module 203 and a value of the voice pitch that is externally input, and outputs the calculated base pitch Fmin to the pitch contour generation module 206.

The pitch contour generation module 206 generates the pitch contour from the input parameters using Expressions (1), (2) and (3), and outputs the generated pitch contour to the speech generation module 103.

Next, a process conducted by the prosody generation module 102 is described in detail.

First, the user sets the voice controlling parameters such as the voice pitch and the intonation in advance. Although only the parameters related to generation of the pitch contour are explained, other parameters such as speech rate, and volume of voice may be considered. If the user does not specify values for the parameters, predetermined values (default values) are set as specified values.

As shown in FIG. 2, the intonation setting value of the voice controlling parameters is sent to the phrase command determination module 202 and the accent command determination module 203 both included in the prosody generation module 102, while the voice pitch setting value is sent to the base pitch determination module 207.

The intonation setting value is a parameter for adjusting the magnitude of the intonation and relates to an operation for changing the magnitudes of the phrase command and the accent command calculated by an appropriate process to values 0.5 times or 1.5 times, for example. The voice-pitch setting value is a parameter for adjusting the entire voice pitch and relates to an operation for directly setting the base pitch Fmin, for example. The details of these parameters will be described later.

The intermediate language input to the prosody generation module 102 is supplied to the intermediate language analysis module 201 in order to be subjected to analysis of the input character string. The analysis in the intermediate language analysis module 201 is performed sentence-by-sentence, for example. Then, from the intermediate language corresponding to one sentence, the number of the phrase commands, the number of moras in each phrase command, and the like are obtained and sent to the phrase command determination module 202. The number of the accent commands, the number of the moras in each accent command and the accent type of each accent command, and the like are obtained and sent to the accent command determination module 203.

A phonetic character string and the like are sent to the phoneme duration determination module 204 and the phoneme power determination module 205. In the phoneme duration calculation module 204 and the phoneme power determination module 205, the duration of each phoneme or syllable, an amplitude value thereof and the like are calculated and sent to the speech generation module 103.

In the phrase command determination module 202, the magnitude of the phrase command and the creation time thereof are calculated. Similarly, in the accent command determination module 203, the magnitude, the start time and the end time of the accent command are calculated. The magnitudes of the phrase command and the accent command are modified by the parameter for controlling the intonation set by the user, not only in a case where the magnitudes are given by rules but also in a case where the magnitudes are predicted by a statistical analysis. For example, a case where the intonation is set to be any one of level 1, level 2 and level 3 and the parameters for the respective levels are 1.5 times, 1.0 time and 0.5 times is considered. In this case, the magnitude given by the rules or predicted by the statistical analysis is multiplied by 1.5 at the level 1; multiplied by 1.0 at the level 2; or multiplied by 0.5 at the level 3. The magnitudes Api and Aaj of the phrase command and the accent command after the multiplication, the creation time T0i of the phrase command and the start time T1j and the end time T2j of the accent command are sent to the pitch contour generation module 206.

The magnitudes of the phrase command and the accent command and the number of moras in each phrase or accent command are sent to the base pitch determination module 207, and subjected to calculation to obtain the base pitch Fmin in the base pitch determination module 207, together with the voice-pitch setting value input by the user.

The base pitch calculated by the base pitch determination module 207 is sent to the pitch contour generation module 206 where the pitch contour is generated in accordance with Expressions (1) to (3). The generated pitch contour is sent to the speech generation module 103.

Next, an operation for generating the pitch contour is described in detail referring to a flow chart.

Figure 3:
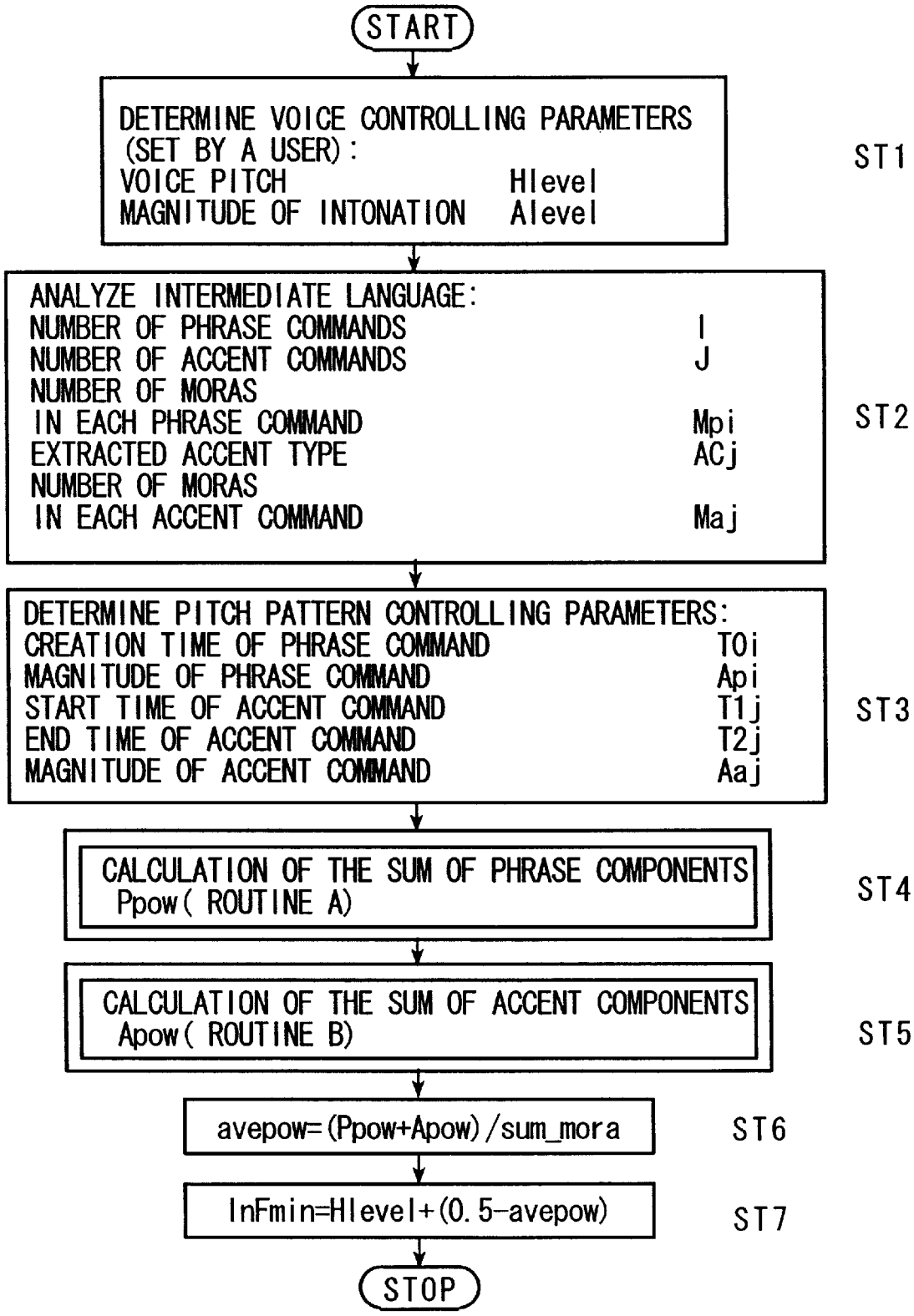
FIG. 3 is a flow chart showing the flow of determination of a base pitch in the prosody generation module according to the first embodiment of the present invention.

FIG. 3 is a flow chart showing a determination flow of the base pitch. In FIG. 3, STn denotes each step in the flow.

In Step ST1, the voice controlling parameters are set by the user. In setting the voice controlling parameters, the parameter for controlling the voice pitch and the parameter for controlling the intonation. are set to Hlevel and Alevel, respectively. Normally,. quantized values are set as Hlevel and Alevel. For example, for Hlevel, any one value of the following three levels, {3.5, 4.0, 4.5}, may be set, while for Alevel any one value of the following three levels, {1.5, 1.0, 0.5}, may be set. If the user does not set a specific value, any one level is selected as a default value.

Next, the intermediate language is analyzed in Step ST2. In the analysis of the intermediate language, the number of phrase commands is I; the number of accent commands is J; the number of moras in the phrase command is Mpi; the accent type extracted from the accent command is ACj; and the number of moras in the accent command is Maj.

For example, specifications of the intermediate language are assumed as follows: the phrase symbol is [P], the accent symbol is [*], the word-boundary symbol is [/] and a string of phonetic characters are Kanas. In this case, a sentence "Arayuru genjitu wo subete jibun no hou he nejimagetanoda." is to be represented as the following intermediate language.

"P arayu * ru / genjituo / P su * bete / P jibun no / ho * -e / nejimageta * noda"

In the present embodiment, an example of the intermediate language in which the magnitudes of the phrase command and the accent command are predicted by a statistical analysis such as Quantification theory (type one) is described. Alternatively, the magnitude of each instruction may be clearly represented in the intermediate language. In this case, the magnitude of the phrase command may be quantized into three levels [P1], [P2] and [P3] that are arranged in order from the highest to the lowest, while the magnitude of the accent command may be quantized into three levels [*], ['], and ["] also arranged in order from the highest to the lowest, for example.

In the above example of intermediate language, the sentence is divided into three phrases "arayuru genjitu o", "subete" and "jibun no ho-e nejimagetanoda". Therefore, the number of phrase command I is 3. Alternatively, when the sentence is divided into six accents "arayuru", "genjitu o", "subete", "jibun no", "ho-e", and "nejimagetanoda" and therefore the number of accent command J is 6. Moreover, the number Mpi of moras in each phrase command is {9, 3, 14}, the extracted accent type ACj of each accent command is {3, 0, 1, 0, 1, 5} and the number Maj of the moras in each accent command is {4, 5, 3, 4, 3, 7}.

Next, the parameters for controlling pitch contour such as the magnitude, the start time and the end time of each of the phrase and accent commands are calculated in Step ST3. In the determination of control of the pitch contour, the creation time and the magnitude of the phrase command, the start time, the end time and the magnitude of the accent command are set to be T0i, Api, T1j, T2j and Aaj, respectively. The magnitude of the accent command Aaj is predicted using a statistical analysis such as Quantification theory (type one). The start time T1j and the end time T2j of the accent command are presumed as relative times from a start time of a vowel generally used as a standard.

Then, the sum Ppow of the phrase components is calculated in Step ST4, and the sum Apow of the accent components is calculated in Step ST5. The calculations of the sum Ppow and the sum Apow will be described with reference to FIG. 4 (routine A) and FIG. 5 (routine B), respectively.

A mora-average value avepow of the sum of the phrase components and the accent components in one sentence of the input text is calculated from the sum Ppow of the phrase components calculated in Step ST4 and the sum Apow of the accent components calculated in Step ST5 using Expression (4) in Step ST6. In Expression (4), sum_mora is the total number of moras.

$$avepow=(Ppow+Apow)/sum_mora \quad (4)$$

After the mora-average value is calculated, a logarithmic base pitch 1nFmin is calculated using Expression (5) in Step ST7, thereby finishing the flow. This means that the average pitch (the sum of the mora-average value avepow and the base pitch) becomes Hlevel+0.5, regardless of the input text. For example, when the mora-average value avepow 0.3 and the mora-average value avepow 0.7 are compared, the base pitch lnFmin in the former case is Hlevel+0.2 and in the latter case is Hlevel−0.2. Here, it is noted that lnF0(t)= lnFmin+the phrase component+the accent component as expressed by Expression (1). Therefore, in both the former and later cases, the average pitch is the same value, i.e., Hlevel+0.5. Please note that the value added to or subtracted from the Hlevel is not limited to 0.5 used in this example.

$$lnFmin=Hlevel+(0.5-avepow) \quad (5)$$

Figure 4:
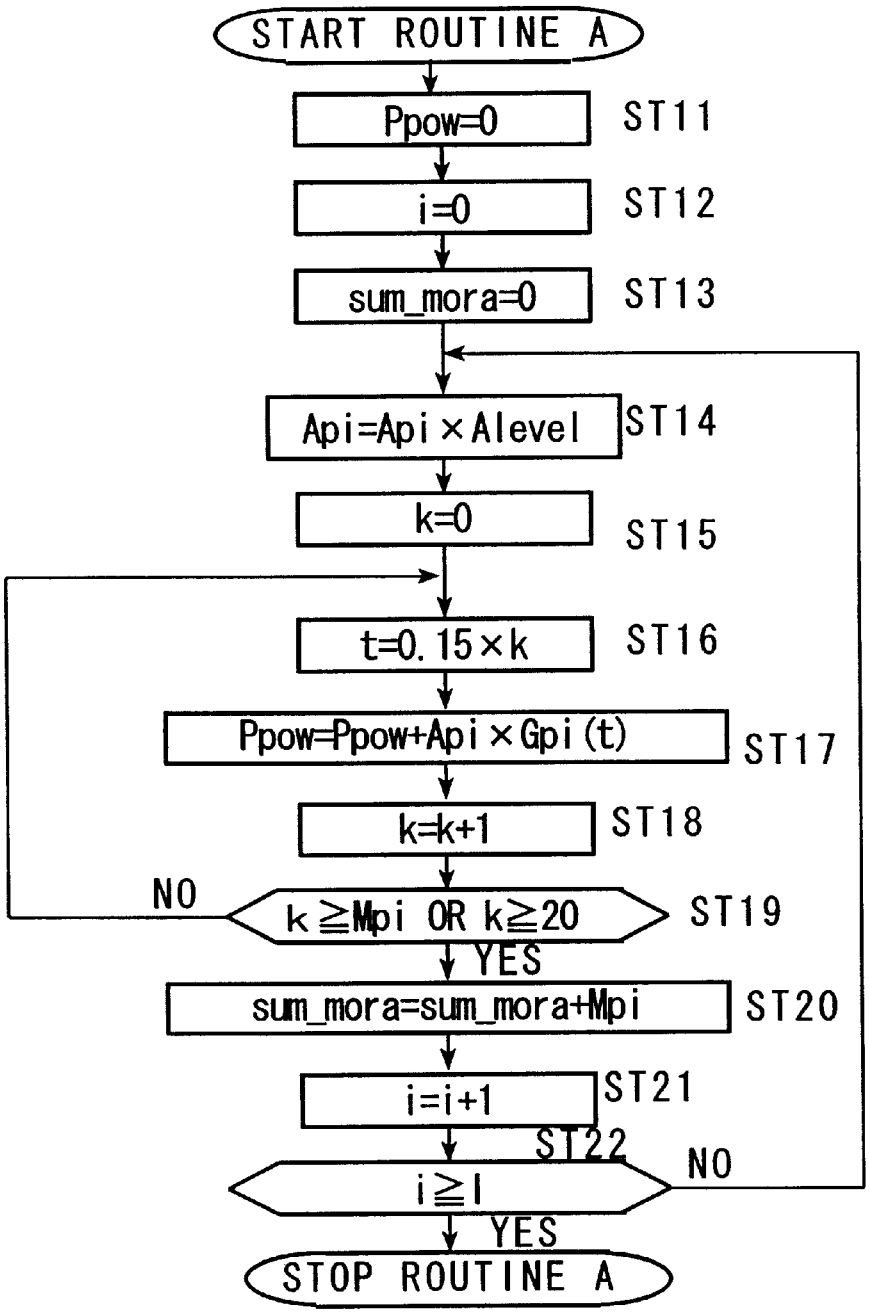
FIG. 4 is a flow chart showing the flow of calculation of the sum of phrase components in the prosody generation module according to the first embodiment of the present invention.

Next, the calculation of the sum of the phrase components is described referring to the flow chart shown in FIG. 4.

FIG. 4 is the flow chart showing a calculation flow of the sum of the phrase components. This flow is a process corresponding to the routine A in Step ST4 in FIG. 3.

First, parameters are initialized in Steps ST11 to ST13, respectively. The parameters to be initialized are the sum Ppow of the phrase components, the phrase command counter i and the counter sum_mora of the total number of the moras. These parameters are set to 0 (Ppow=0, i=0 and sum_mora=0.)

Then, for the i-th phrase command, the magnitude of the phrase command is modified by Expression (6) in Step ST14 in accordance with the intonation level Alevel set by the user.

$$Api=Api\times Alevel \quad (6)$$

Subsequently, the counter k of the number of moras in each phrase is initialized to be 0 (k=0) in Step ST15. Then, the component value of the i-th phrase command per mora is calculated in Step ST16. By performing the calculation of the component value mora-by-mora, the volume of data can be reduced.

If a value of 400 [mora/minute] is used as a normal speech rate, for example, a time period per mora is 0.15 seconds. Therefore, a relative time t of the k-th mora from the phrase creation time is expressed by 0.15×k, and the phrase component value at that time is expressed by Api×Gpi (t).

In Step ST17, this result (the phrase component value is Api×Gpi(t)), is added to the sum of the phrase components Ppow (Ppow=Ppow+Api×Gpi (t)). In Step ST18, the counter k of the number of moras in each phrase is increased by one (k=k+1).

Then, in Step ST9 it is determined whether or not the counter k of the number of moras in each phrase exceeds the number Mpi of moras in the i-th phrase command or 20 moras (k≧Mpi or k≧20). If the counter k of the number of moras in each phrase does not exceed the number Mpi of moras of the i-th phrase command or 20 moras, the procedure goes back to. Step ST16 and the above process is repeated.

If the counter k of the number of moras in each phrase exceeds the number Mpi of moras in the i-th phrase command or 20 moras, it is then determined that the process for the i-th phrase command is finished and the procedure goes to Step ST20.

When the counter k of the number of moras in each phrase exceeds 20 moras, the phrase component value can be considered to be attenuated sufficiently, as is found from Expression (2). Therefore, in order to reduce the volume of data, the present embodiment uses 20 moras as a limit value.

When the process for the i-th phrase command is finished, the number Mpi of moras in the i-th phrase command is added to the counter sum_mora of the total number of moras in Step ST20 (sum_mora=sum_mora+Mpi), and the phrase command counter i is increased by one (i=i+1) in Step ST21. Then, the process for the next phrase command is performed.

In Step ST22, whether or not the phrase command counter i is equal to or larger than the number of phrase commands I (i≧I) is determined. When i<I, the procedure goes back to Step ST14 because the process has not been finished for all syllables in the input text yet. Then, the process is repeated for the remaining syllable(s).

The above-mentioned process is repeatedly performed for the 0-th to (I−1) th phrase commands. When i≧I, the process is finished for all syllables in the input text, thus the sum of the phrase components Ppow and the total number sum_mora of the moras in the input text are obtained.

Next, the calculation of the sum of accent components is described with reference to the flow chart shown in FIG. 5.

Figure 5:
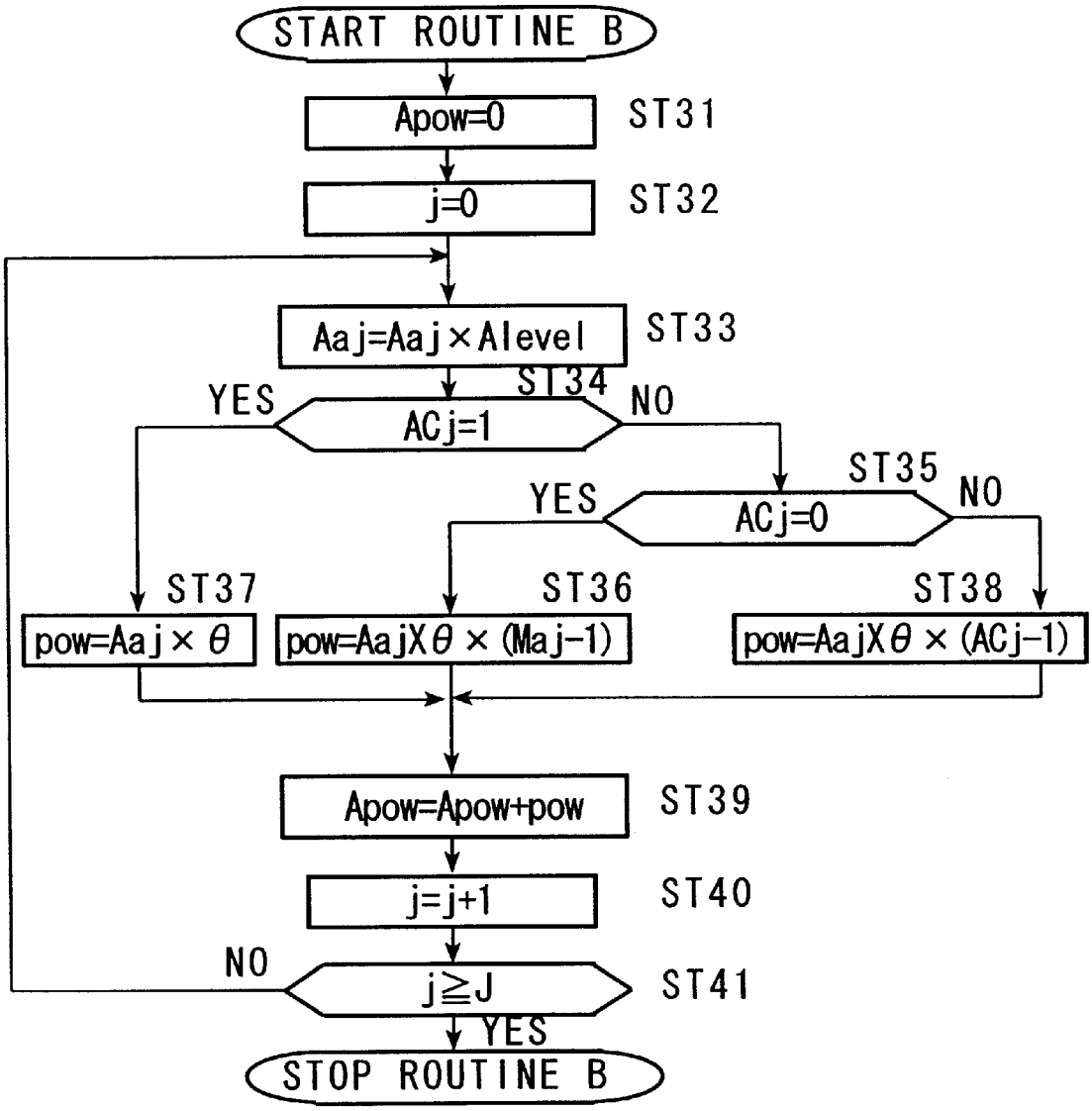
FIG. 5 is a flow chart showing the flow of calculation of the sum of accent components in the prosody generation module according to the first embodiment of the present invention.

FIG. 5 is a flow chart showing the calculation flow of the sum of the accent components that corresponds to the routine B in Step ST5 shown in FIG. 3.

First, parameters are initialized in Steps ST31 and ST32, respectively. The parameters to be initialized are the sum of the accent components Apow and the accent command counter j, and are set to 0 (Apow=0, j=0).

Next, in Step ST33, for the j-th accent command, the magnitude of the accent command is modified by Expression (7) in accordance with the intonation level Alevel set by the user.

$$Aaj=Aaj\times Alevel \quad (7)$$

In Step ST34, it is determined whether or not the accent type ACj of the j-th accent command is one. If the ACj is not one, then whether or not the accent type ACj of the j-th accent command is zero is determined in Step ST35.

When the accent type ACj of the j-th accent command is zero (i.e., the unaccented word), the accent component value is approximated by Aaj×θ×(Maj−1) in Step ST36. When the accent type ACj of the j-th accent command is one, the accent component value is approximated by Aaj×θ in Step ST37. In other cases, the accent component value is approximated by Aaj×θ×(ACj−1) in Step ST38.

When the approximation using the accent component value is completed, the accent component value pow in each accent type is added to the sum of the accent components Apow (Apow=Apow+pow) in Step ST39, and the accent command counter j is increased by one (j=j+1) in Step ST40. Then, the process for the next accent command is performed.

In Step ST41, it is determined whether or not the accent command counter j is equal to or larger than the count J of the number of the accent commands (j≧J). If j<J, the process goes back to Step ST33 because the procedure has not been performed for all syllables in the input text yet. Then, the process is repeatedly performed for the remaining syllable (s).

The above-mentioned process is repeatedly performed for the 0-th to the (J−1) th accent commands. When j≧J, the process is finished for all syllables in the input text, thus the sum of the accent components Apow is obtained.

A specific example of an operation by the calculation flow of the accent component described above is described in the following.

In the Tokyo dialect of Japanese, an accent of a word is described by an arrangement of high pitch and low pitch syllables (moras) constituting the word. A word including n moras may have any of (n+1) accent types. The accent type of the word is determined when the mora at which the accent nucleus exists is specified. In general, the accent type is expressed with the mora position at which the accent nucleus exists counted from a top of the word. A word having no accent nucleus is type 0.

Figure 6:
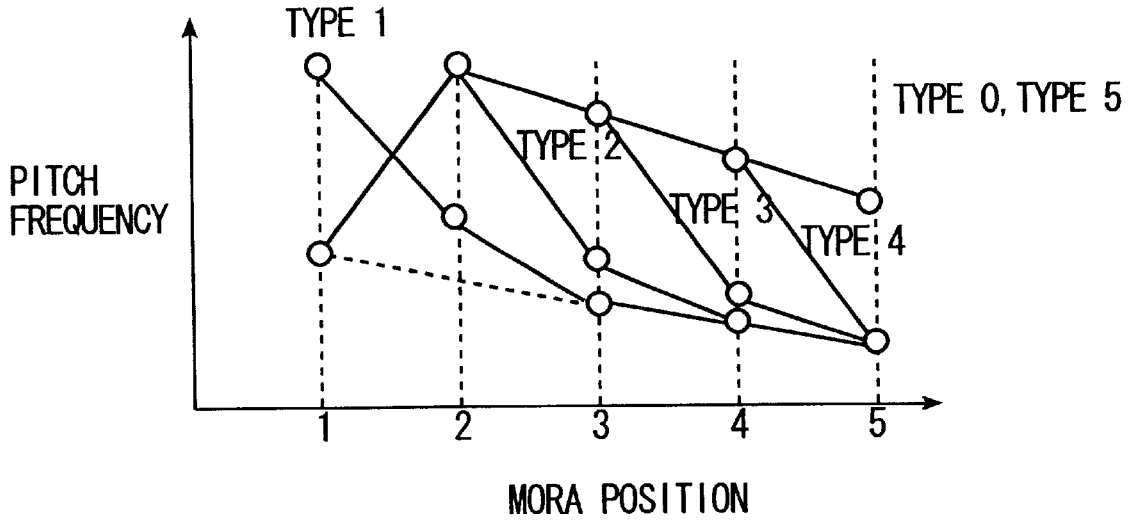
FIG. 6 is a diagram showing a pattern of pitches at points (a transition of pitch at a barycenter of a vowel) corresponding to each accent type of a word including 5 moras in the prosody generation module according to the first embodiment of the present invention.

FIG. 6 shows a pattern of pitches at points (a transition of pitch at a barycenter of a vowel) corresponding to each accent type of a word including 5 moras.

Basically, the point-pitch contour of the word starts with a low pitch; rises at the second mora; generally falls from the mora having the accent nucleus to the next mora; and ends with the last pitch, as shown in FIG. 6. However, it is noted that the type 1 accent word starts with a high pitch at the first mora, and in the type n word having n moras and the type 0 word having n moras, the pitch does not generally fall. This result is further simplified, for example, for a type 0 accent word "pasokon" meaning a personal computer in Japanese, a type 1 accent word "kinzoku" meaning metal in Japanese, a type 2, accent word "idomizu" meaning water in a well in Japanese and a type 3 accent word "kaminoke" meaning hair in Japanese. The simplified accent functions are shown in FIGS. 7A to 7D.

FIGS. 7A to 7D show a comparison of simplified pitch contours between words having different accent types.

It is assumed that the pitch falls at the end time of the last syllable in an unaccented word while the pitch falls at the end time of a syllable having the accent nucleus in accented word, as shown in FIGS. 7A to 7D. When delays of rise and fall of the accent component are ignored as shown in FIGS. 7A to 7D, the calculation of the accent component value can be simplified as in the flow chart shown in FIG. 5.

As described above, in the speech synthesis apparatus according to the first embodiment of the present invention, the prosody generation module 102 comprises the intermediate language analysis module 201, the phrase command determination module 202, the accent command determination module 203, the phoneme duration determination module 204, the phoneme power determination module 205, the pitch contour generation module 206 and the base pitch determination module 207. The base pitch determination module 207 calculates the average avepow of the sum of the phrase components Ppow and the sum of the accent components Apow from the approximation of the pitch contour, after the creation time T0i and the magnitude Api of the phrase command, the start time T1j, the end time T2j and the magnitude Aaj of the accent command are calculated, and then determines the base pitch so that a value obtained by adding the average value avepow and the base pitch is always constant. Accordingly, the fluctuation of the average pitch between sentences can be suppressed, thus synthesized speech that is easy to hear can be produced.

In other words, although the conventional method has a problem where the synthesized speech is hard to hear because the voice pitch fluctuates depending on the word-structure of the input text, in the present embodiment the voice pitch does not fluctuate and therefore the fluctuation of the average pitch can be suppressed for any word-structure of the input text. Therefore, synthesized speech that is easy to hear can be produced.

Although the constant for determining the base pitch is set to 0.5 (see Step ST7 in FIG. 3) in the first embodiment, the constant is not limited to this value. In addition, in order to reduce the volume of data, the process for obtaining the sum of the phrase components is stopped when it reaches 20 moras in the first embodiment. However, the calculation may be performed in order to obtain a precise value.

In the first embodiment, the prosody generation module 102 calculates the average value of the sum of the phrase components and the accent components and then determines the base pitch so that a value obtained by adding the thus obtained average value and the base pitch is always constant. In the next embodiment, the prosody generation module 102 obtains a difference between the maximum value and the minimum value of the pitch contour of the entire sentence from the phrase components and the accent components that are calculated, and then modifies the magnitude of the phrase component and that of the accent component so that the obtained difference becomes the set intonation.

Figure 8:
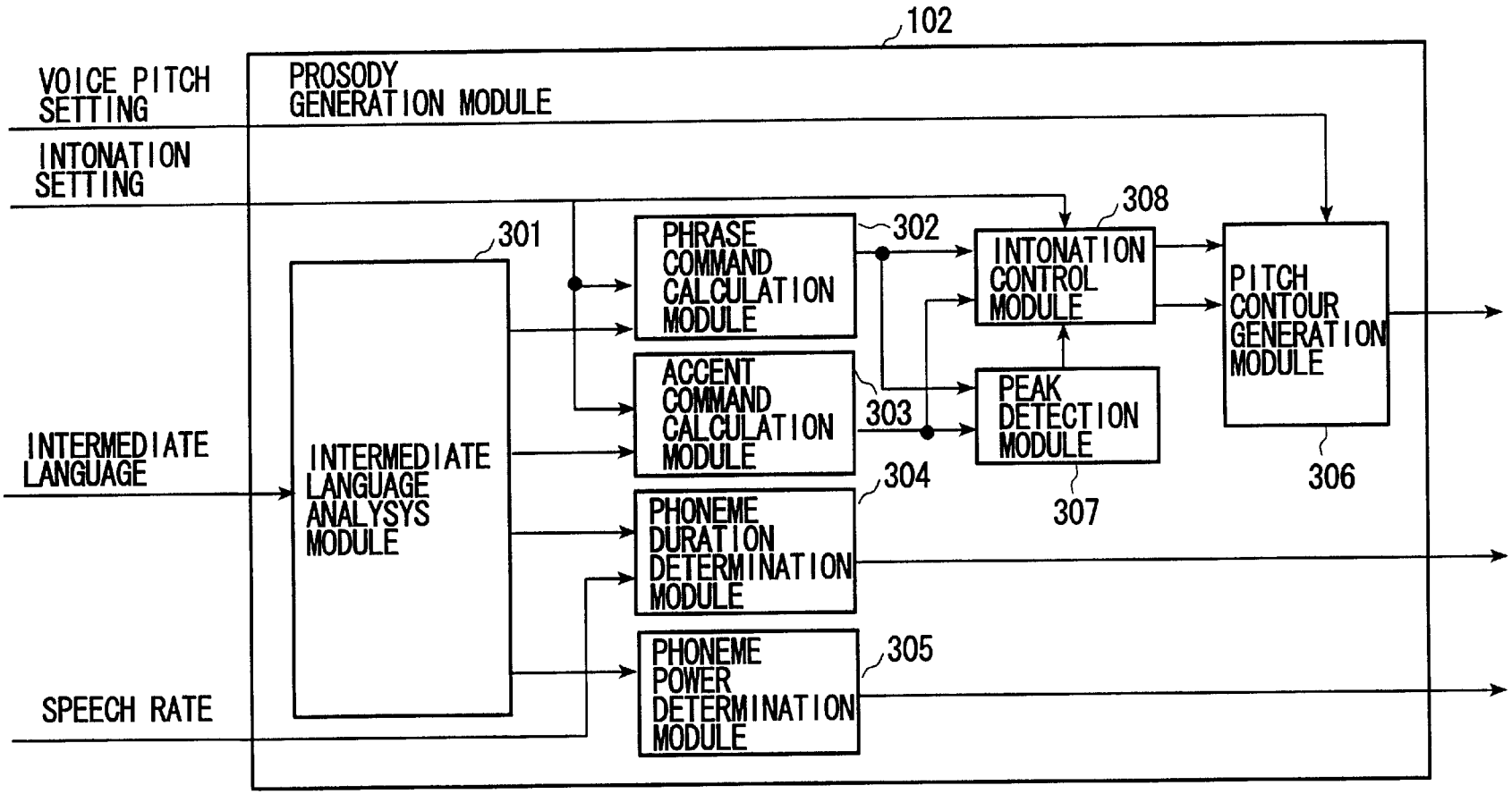
FIG. 8 is a block diagram schematically showing a structure of a prosody generation module according to a second embodiment of the present invention.

FIG. 8 is a block diagram schematically showing a structure of the prosody generation module of the speech synthesis apparatus according to the second embodiment of the present invention. Main features of the present invention are in the method for generating the pitch contour, as in the first embodiment.

As shown in FIG. 8, the prosody generation module 102 includes an intermediate language analysis module 301, a phrase command calculation module 302, an accent command calculation module 303, a phoneme duration calculation module 304, a phoneme power determination module 305, a pitch contour generation module 306, a peak detection module 307 (a calculating means), and an intonation control module 308 (a modifying portion).

The intermediate language in which the prosodic symbols are added is input to the prosody generation module 102. In some cases, voice parameters such as a voice pitch, intonation indicating the magnitude of the intonation or a speech rate, may be set externally, depending on the user's preference or the usage.

The intermediate language is input to the intermediate language analysis module 301 wherein the intermediate language is subjected to interpretation of the phonetic symbols, the word-end symbols, the accent symbols and the like in order to be converted into necessary parameters. The parameters are output to the phrase command calculation module 302, the accent command calculation module 303, the phoneme duration determination module 304 and the phoneme power determination module 305. The parameters will be described in detail later.

The phrase command calculation module 302 calculates the creation time T0i and the magnitude Api of the phrase command from the input parameters, and outputs them to the intonation control module 308 and the peak detection module 307.

The accent command calculation module 303 calculates the start time T1j, the end time T2j and the magnitude Aaj of the accent command from the input parameters, and outputs them to the intonation control module 308 and the peak detection module 307. At this time, the magnitude Api of the phrase command and the magnitude Aaj of the accent command are undetermined.

The phoneme duration determination module 304 calculates the duration of each phoneme from the input parameters and outputs it to the speech generation module 103. At this time, in a case where the user sets the speech rate, the speech rate set by the user is input to the phoneme duration determination module 304 which outputs the phoneme duration obtained by taking the set value of the speech rate into consideration.

The phoneme power determination module 305 calculates an amplitude shape of each phoneme from the input parameters and outputs it to the speech generation module 103.

The peak detection module 307 calculates the maximum value and the minimum value of the pitch frequency using the parameters output from the phrase command calculation module 302 and the accent command calculation module 303. The result of the calculation is output to the intonation control module 308.

To the intonation control module 308 are input the magnitude of the phrase command from the phrase command calculation module 302, the magnitude of the accent command from the accent command calculation module 303, the maximum value and the minimum value of the overlapped phrase and accent components from the peak detection module 307, and the intonation level set by the user.

The intonation control module 308 uses the above parameters and modifies the magnitudes of the phrase command and the accent command, if necessary. The result is output to the pitch contour generation module 306.

The pitch contour generation module 306 generates the pitch contour in accordance with Expressions (1) to (3) from the parameters input from the intonation control module 308 and the level of the voice pitch set by the user. The generated pitch contour is output to the speech generation module.

The details of a procedure in the prosody generation module 102 according to the second embodiment is described below.

First, the user sets the parameters for controlling the voice, such as the voice pitch, the intonation or the like, in accordance with the user's preference or the limitation or the usage. Although only the parameters related to the generation of the pitch contour are described in the present embodiment, other parameters such as a speech rate, a volume of the voice, may be set. If the user does not set the parameters, predetermined values (default values) are set.

As shown in FIG. 8, the intonation setting value of the voice controlling parameters is sent to the intonation control module 308 in the prosody generation module 102, while the voice-pitch setting value is sent to the pitch contour generation module 306. The intonation setting value is a parameter for adjusting the magnitude of the intonation and relates to an operation for changing the magnitudes of the phrase command and the accent command so that the overlapped phrase and accent commands is made substantially the same as the set values, for example. The voice-pitch setting value is a parameter for adjusting the entire voice pitch and relates to an operation for directly setting the base pitch Fmin, for example. The details of these parameters will be described later.

The intermediate language input to the prosody generation module 102 is supplied to the intermediate language analysis module 301 so as to be subjected to analysis of the input character string. The analysis in the intermediate language analysis module 301 is performed sentence-by-sentence, for example. Then, from the intermediate language corresponding to one sentence, the number of the phrase commands, the number of the moras in each phrase command, and the like are obtained and sent to the phrase command determination module 302, while the number of the accent commands, the number of the moras in each accent command and the accent type of each accent command, and the like are obtained and sent to the accent command calculation module 303.

The phonetic character string and the like are sent to the phoneme duration determination module 304 and the phoneme power determination module 305. In the phoneme duration calculation module 304 and the phoneme power determination module 305, a duration of each phoneme or syllable and an amplitude value thereof are calculated and are sent to the speech generation module 103.

In the phrase command determination module 302, the magnitude of the phrase command and the creation time thereof are calculated. Similarly, in the accent command calculation module 303, the magnitude, the start time and the end time of the accent command are calculated. The calculations of the phrase command and the accent command can be performed by any method. For example, the phrase command and the accent command can be calculated from the arrangement of the phonetic characters in the string by rules or can be expected by a statistical analysis.

The controlling parameters of the phrase command and the accent command that are respectively calculated by the phrase command calculation module 302 and the accent command calculation module 303 are sent to the peak detection module 307 and the intonation control module 308.

The peak detection module 307 calculates the maximum value and the minimum value of the pitch contour after the base pitch Fmin is removed, by using Expressions (1) to (3). The calculation result is sent to the intonation control module 308.

The intonation control module 308 modifies the magnitude of the phrase command and that of the accent command, that are calculated by the phrase command calculation module 302 and the accent command calculation module 303, respectively, by using the maximum value and the minimum value of the pitch contour that have been obtained by the peak detection module 307.

The intonation controlling parameter set by the user has five levels that are respectively defined to be {0.8, 0.6, 0.5, 0.4, 0.2}, for example. One of the values of these levels is set into the intonation control module 308. These level values directly define the intonation component. In other words, in a case of 0.8 that is the value of the level 1, this value means that the modification is performed so as to make the difference value between the maximum value and the minimum value of the pitch contour obtained before to be 0.8. If the user does not set the intonation, the modification is performed by using default values for the five levels.

The magnitude A'pi of the phrase command and the magnitude A'aj of the accent command after they are subjected to the above process, and the start times and the end time thereof T0i, T1j and T2j are sent to the pitch contour generation module 306.

The pitch contour generation module 306 generates the pitch contour by using the base pitch Fmin set by the user and the parameters sent from the intonation control module 308 in accordance with Expressions (1) to (3). The generated pitch contour is sent to the speech generation module 103.

Next, an operation for modifying the magnitudes of the phrase command and the accent command is described in detail referring to a flow chart.

Figure 9:
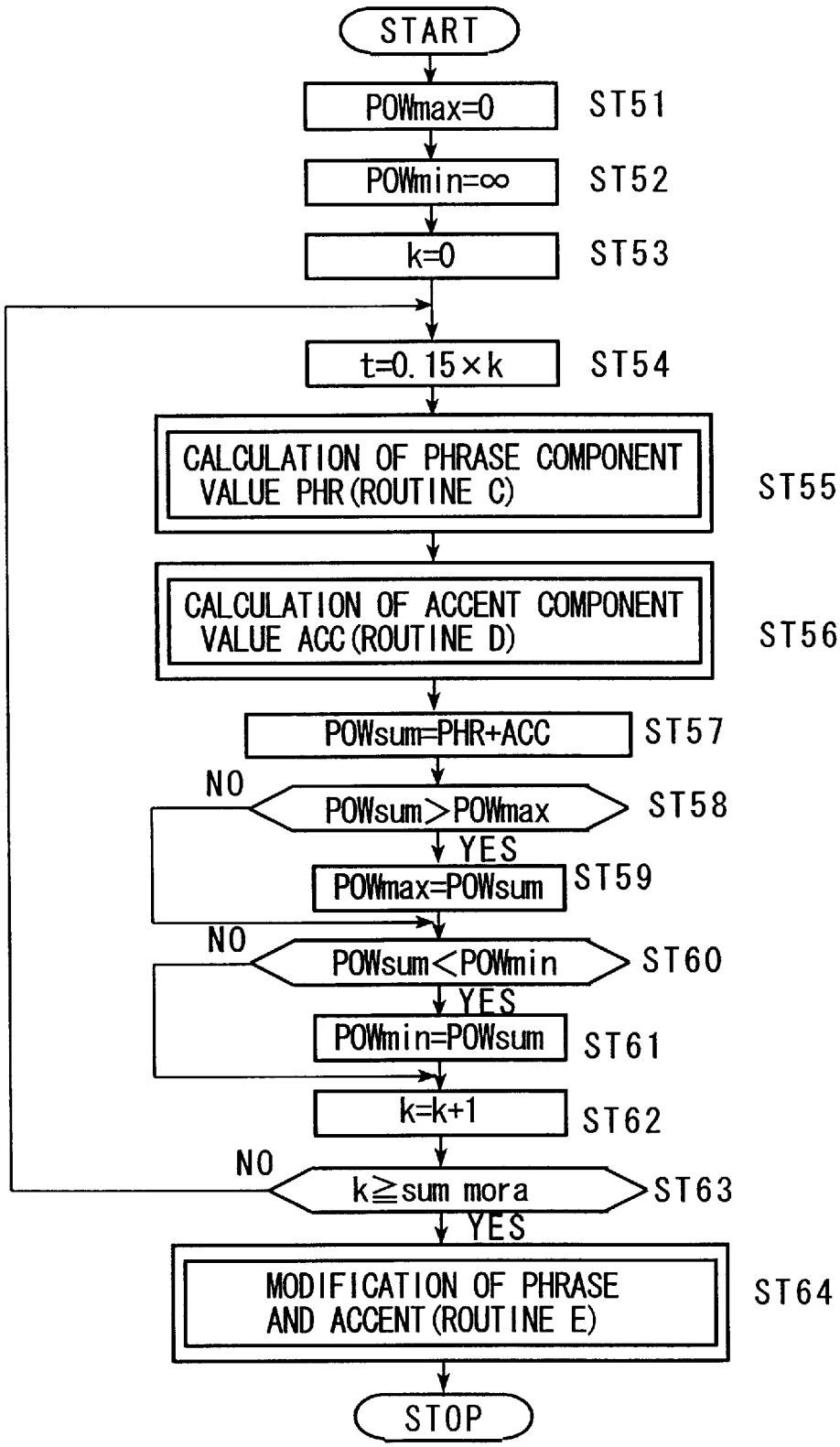
FIG. 9 is a flow chart showing the flow of control of intonation in a prosody generation module according to the second embodiment of the present invention.

FIG. 9 is the flow chart showing a flow of controlling the intonation. The flow includes sub-routines respectively shown in FIGS. 11, 12 and 13. The processes shown in these flow charts are performed by the intonation control module 308 and correspond to flows of modifying the magnitude Api of the phrase command calculated by the phrase command calculation module 302 and the magnitude Aaj of the accent command calculated by the accent command calculation module 303 with the intonation controlling parameter Alevel set by the user, so as to obtain the modified magnitude A'pi of the phrase command and the modified magnitude A'aj of the accent command.

First, parameters are initialized in Steps ST51 to ST53, respectively. The parameter POWmax for storing the maximum value of the overlapped phrase and accent components (hereinafter, referred to as phrase-accent overlapped component) is initialized to be 0; the parameter POWmin for storing the minimum value thereof is initialized to be a value close to infinity (for example, 1.0exp50); and the counter k of the number of the moras is initialized to be 0 (POWmax=0, POWmin=∞, k=0).

Next, the phrase-accent overlapped component is calculated for the k-th mora in the input text in Step ST54. By calculating the component value mora-by-mora, the throughput can be saved, as in the first embodiment. As described above, the relative time t of the k-th mora from the start time of the speech is expressed as 0.15×k (t=0.15×k).

In Step ST55, the phrase component value PHR is calculated. Then, in Step ST56, the accent component value ACC is calculated. The calculation of the phrase component value PHR will be described later with reference to FIG. 11 (sub-routine C), and the calculation of the accent component value ACC will be described later with reference to FIG. 12 (sub-routine D).

Then, the phrase-accent overlapped component value POWsum in the k-th mora is obtained by Expression (8) in Step ST57.

$$\text{POWsum}=PHR+ACC \tag{8}$$

Next, the maximum value POWmax and the minimum value POWmin of the phrase-accent overlapped component are updated in Steps ST58 to ST63.

More specifically, the phrase-accent overlapped component POWsum is determined whether or not it is larger than the maximum value POWmax of the phrase-accent overlapped component value (POWsum>POWmax) in Step ST58. When POWsum>POWmax, the phrase-accent overlapped component POWsum is determined to exceed the maximum value POWmax of the phrase-accent overlapped component and therefore the maximum value POWmax is updated to be the phrase-accent overlapped component value POWsum in Step ST59. Subsequently, the procedure goes to Step ST60. When POWsum≦POWmax, the procedure goes directly to Step ST60 because the phrase-accent overlapped component POWmax does not exceed the maximum value POWmax of the phrase-accent overlapped component value.

In Step ST60, it is determined whether or not the phrase-accent overlapped component value POWsum is smaller than the minimum value POWmin of the phrase-accent overlapped component value (POWsum<POWmin). When POWsum<POWmin, the phrase-accent overlapped component POW sum is determined to be smaller than the minimum value POWmin of the phrase-accent overlapped component and therefore the minimum value POWmin is updated to be the phrase-accent overlapped component value POWsum in Step ST61. The procedure then goes to Step ST62. On the other hand, when POWsum≧POWmin, the phrase-accent overlapp ed component value POWsum is determined not to exceed the minimum value POWmin of the phrase-accent overlapped component value. Therefore, the procedure goes directly to Step ST62.

Subsequently, the counter k of the number of the moras is increased by one in Step ST62 (k=k+1) and thereafter the process is performed for the next mora similarly. In Step ST63, the counter k of the number of the moras is determined whether to be equal to or larger than the total number sum_mora of the moras in the input text or not (k≧sum_mora). When k<sum_mora, the procedure goes back to Step ST54 because all syllables in the input text have not been processed yet so as to perform the process for all the syllables repeatedly.

In this way, when the counter k of the number of the moras reaches or exceeds the total number sum_mora of the moras in the input text (k≧sum_mora), the maximum value POWmax and the minimum value POWmin are determined. Then, the modifying process for the phrase component and the accent component starts in Step ST64, thereby finishing the flow shown in FIG. 9. The modifying process for the phrase component and the accent component will be described later with reference to FIG. 13 (routine E).

Figure 10:
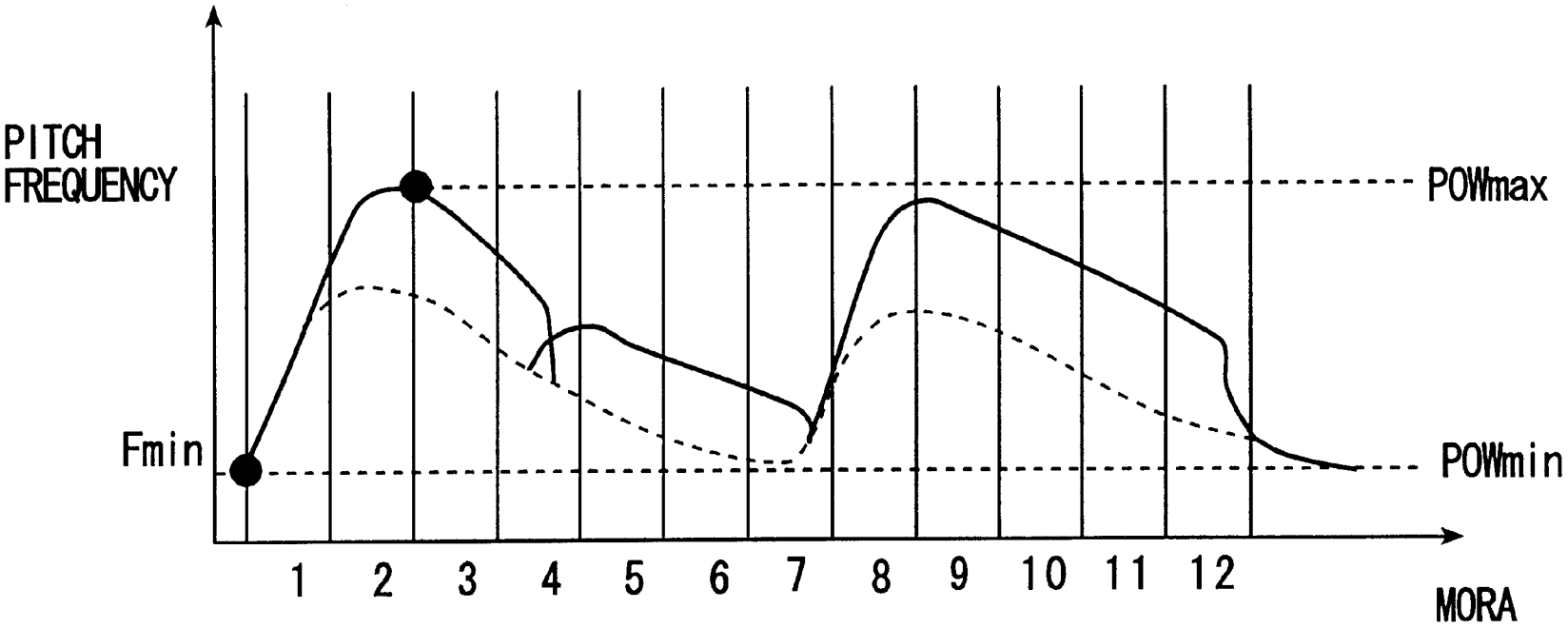
FIG. 10 is a diagram showing a maximum value and a minimum value in a mora-by-mora pitch contour in the prosody generation module according to the second embodiment of the present invention.

The maximum value and the minimum value obtained by the above process are shown in FIG. 10. FIG. 10 shows the maximum value and the minimum value of the pitch contour considering one mora as a unit. In FIG. 10, a waveform by a broken line represents the phrase component while a waveform by a solid line represents the phrase-accent overlapped component.

Figure 11:
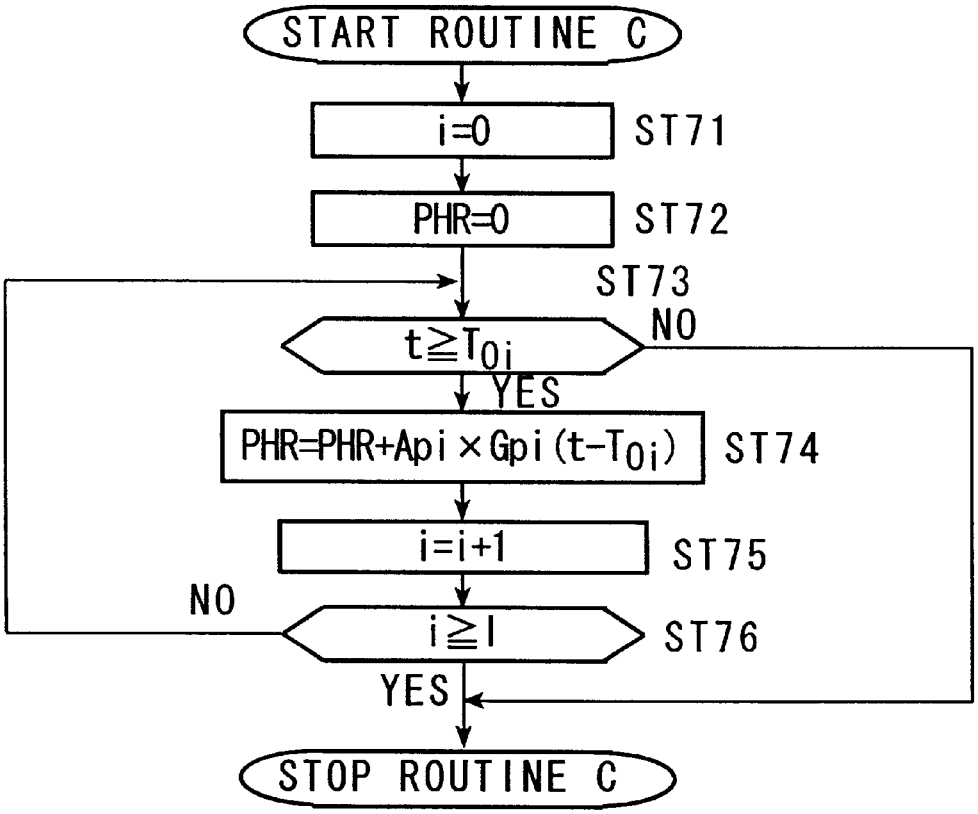
FIG. 11 is a flow chart showing the flow of calculation of a phrase component value PHR in the prosody generation module according to the second embodiment of the present invention.

Next, the calculation of the phrase component value is described referring to FIG. 11.

FIG. 11 is a flow chart showing a calculation flow of the phrase component value PHR. This flow corresponds to the sub-routine C in Step ST55 in FIG. 9.

In order to obtain the phrase component value PHR in the k-th mora, the phrase command counter i is initialized to 0(i=0) in Step ST71, and the phrase component value PHR is also initialized to 0(PHR=0) in Step ST72.

Next, in Step ST73, it is determined whether or not the current time t is equal to or larger than the creation time T0i of the i-th phrase command (t≧T0i). When t<T0i, the creation time T0i of the i-th phrase command is later than the current time t. Therefore, it is determined that the i-th phrase command and the succeeding phrase commands are not influenced, and the process is stopped so as to finish this flow.

When t≧T0i, the i-th phrase component value PHR is calculated in accordance with Expression (9) in Step ST74.

$$PHR=PHR+Api\times Gpo(t-T0i) \tag{9}$$

When the process for the i-th phrase command is finished, the phrase command counter i is increased by one (i=i+1) in Step ST75 and the process for the next phrase command is started. In Step ST76, it is determined whether or not the phrase commend counter i is equal to or larger than the count I of the number of the phrase commands (i≧1). When i<I, the procedure goes back to Step ST73 because the process has not been performed for all syllables in the input text, and the process is performed for the remaining syllable(s).

The above-mentioned process is performed at the current time t for each of the 0-th to the (I−1) th phrase commands so as to add the magnitude of the phrase component to PHR. When i≧I, the process is finished for all the syllables in the input text, and the phrase component value PHR in the k-th mora is obtained at the time at which the process for the last phrase (i.e., the (I−1) th phrase) has been finished.

Figure 12:
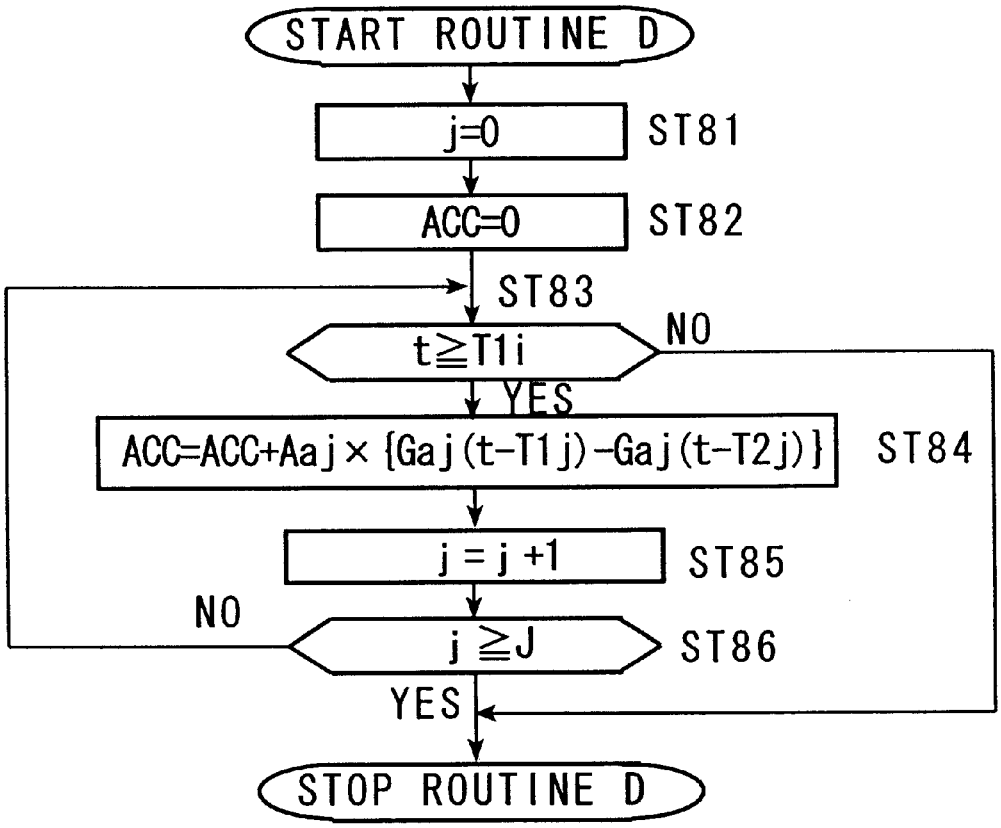
FIG. 12 is a flow chart showing the flow of calculation of an accent component value ACC in the prosody generation module according to the second embodiment of the present invention.

Next, the calculation of the accent component value is described referring to a flow chart shown in FIG. 12.

The flow chart shown in FIG. 12 shows a flow of the calculation of the accent component value ACC. This flow corresponds to the sub-routine D in Step ST56 in FIG. 9.

Similarly to the calculation of the phrase component, in order to obtain the accent component value ACC in the k-th mora, the accent command counter j is initialized to 0 (j=0) in Step ST81. Then, the accent component value ACC is also initialized to 0 (ACC=0) in Step ST82.

In Step ST83, it is determined whether or not the current time t is equal to or larger than the rising time T1j of the j-th accent command (t≧T1j). When t<T1j, the rising time T1j of the j-th accent command is later than the current time t. Therefore, it is determined that the j-th accent command and the succeeding accent commands are not influenced, thereby the process is stopped and this flow is finished.

When t≧T1j, the magnitude of the accent command is added to ACC for each of the 0-th to (J−1) th accent commands at the current time t in accordance with Expression (10) in Step ST84.

$$ACC=ACC+Aaj\times\{Gaj\ (t-T1j)-Gaj\ (t-T2j)\} \quad (10)$$

When the process for the j-th accent command is finished, the accent command counter j is increased by one (j=j+1) in Step ST85, and then the process for the next accent command is performed. In Step ST86, it is determined whether or not the accent command counter j is equal to or larger than the count J of the number of the accent commands (j≧J). When j<J, the flow goes back to Step ST83 because the process has not been finished for all the syllables in the input text yet. Then, the process is repeated for the remaining syllable(s).

The above-mentioned process is performed for each of the 0-th to the (J−1) th accent commands at the current time t so as to add the magnitude of the accent component to ACC. When j>J, the process for all the syllables in the input text has been finished, and the accent component value ACC in the k-th mora at the time at which the process for the last accent (i.e., the (J−1) th accent) has been finished is obtained.

Next, the modification of the phrase component and the accent component is described with reference to a flow chart shown in FIG. 13.

Figure 13:
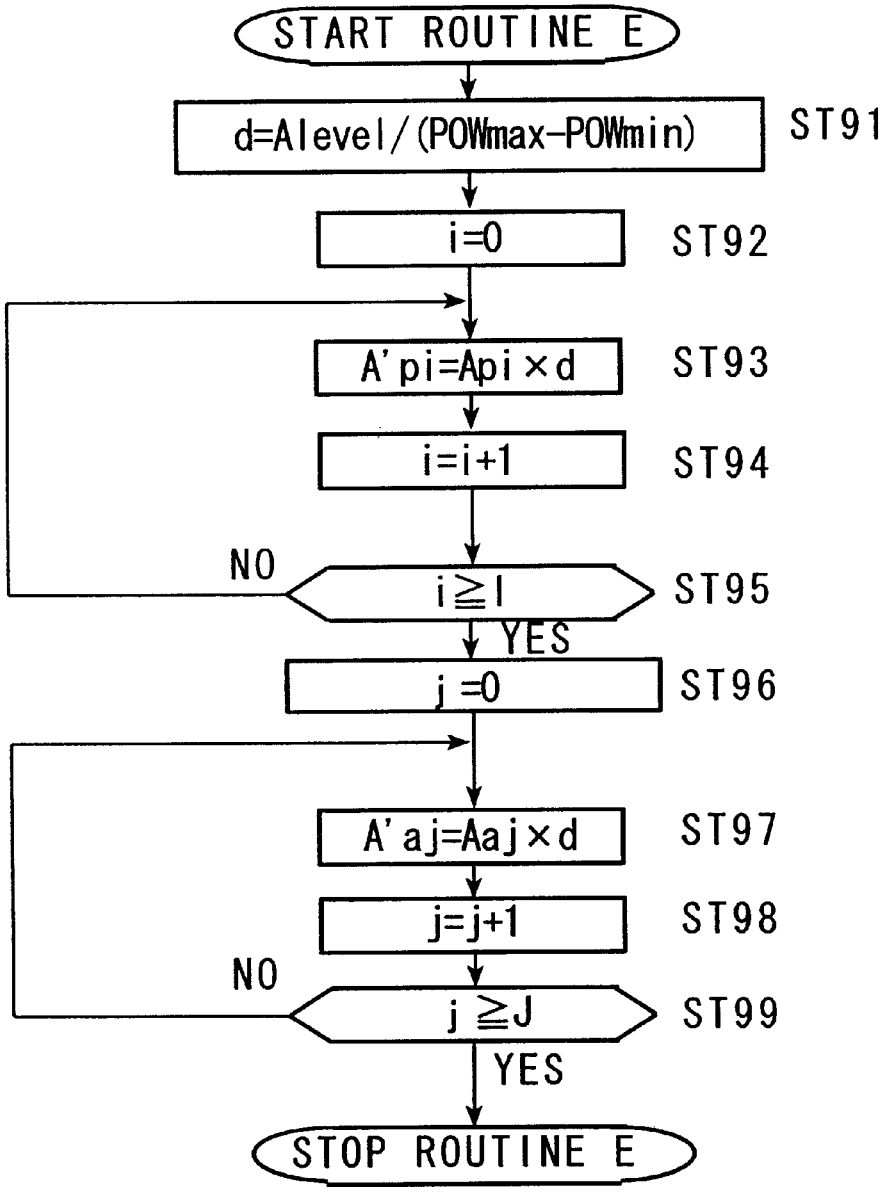
FIG. 13 is a flow chart showing the flow of modification of the phrase component and the accent component in the prosody generation module according to the second embodiment of the present invention.
Figure 14:
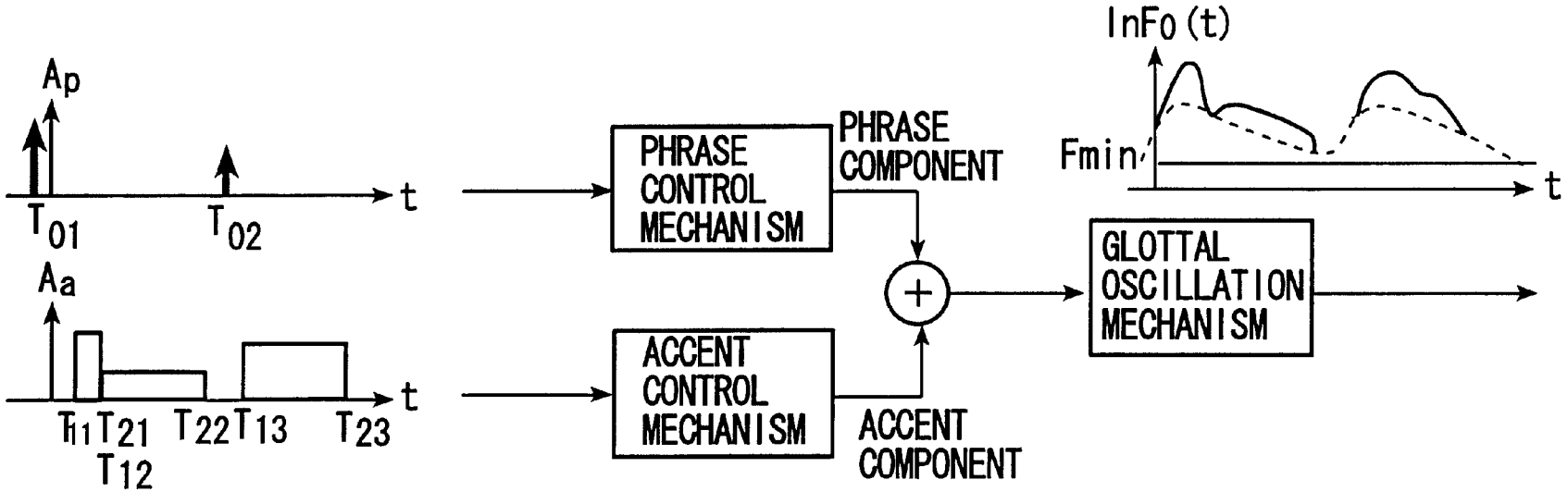
PRIOR ART Fig. 14
FIG. 14 is a diagram explaining a model for the process of generating pitch contour.

The flow chart shown in FIG. 13 shows a flow of modifying the phrase component and the accent component. The flow corresponds to the sub-routine E in Step ST64 in FIG. 9.

In Step ST91, a multiplier d to be used for modifying the phrase component and the accent component is calculated by Expression(11).

$$d=\text{Alevel}/(\text{POWmax}-\text{POWmin}) \quad (11)$$

Then, the phrase command counter i is initialized to 0 (i=0) in Step ST92. In Step ST93, the phrase component value Api of the i-th phrase command is multiplied by the multiplier d so as to calculate the processed phrase component value A'pi (A'pi=Api×d).

Subsequently, the phrase command counter i is increased by one (i=i+1) in Step ST94. The phrase command counter i is then determined whether to be equal to or larger than the count I of the number of the phrase commands (i≧I) or not, in Step ST95. When i<I, the flow goes back to Step ST93 because the process has not been finished for all the syllables in the input text yet. Then, the process is repeated for the remaining syllable(s).

When i≧I, in order to modify the accent component, the accent command counter j is initialized to 0 (j=0) in Step ST96, and the accent component value Aaj of the j-th accent command is multiplied by the multiplier d so as to calculate the processed accent component value A'aj (A'aj=Aaj×d) in Step ST97.

Then, the accent command counter j is increased by one (j=j+1) in Step ST98, and it is determined whether or not the accent command counter j is equal to or larger than the counter J of the number of the accent commands (j≧J) in Step ST99. When j<J, the flow goes back to Step ST97 because the process has not been finished for all the syllables in the input text, and the process is then repeated for the remaining syllable(s). On the other hand, j≧J, it is determined that the modification of the phase component and the accent has been finished, and therefore this flow is finished.

In this way, the multiplier d is obtained and then the component value of each of the 0-th to th (I−1)th phrase commands and the 0-th to the (J−1)th accent commands is multiplied by the multiplier d. The process phrase component A'pi and the processed accent component A'aj are sent to the pitch contour generation module 306 together with the creation time T0i of each phrase command, the rising time T1j and the falling time T2j of each accent command, in which the pitch contour is generated.

As described above, the prosody generation module 102 of the speech synthesis apparatus according to the second embodiment of the present invention includes: the peak detection module 307 that calculates the maximum value and the minimum value of the pitch frequency by using the parameters output from the phrase command calculation module 302 and the accent command calculation module 303; and the intonation control module 308 to which the magnitude of the phrase command from the phrase command calculation module 302, the magnitude of the accent command from the accent command calculation module 303, the maximum value and the minimum value of the phrase-accent overlapped component from the peak detection module 307, and the intonation level set by the user are input and which modifies the magnitudes of the phrase command and the accent command by using these parameters. In the prosody generation module 102, after the creation time T0i and the magnitude Api of the phrase command, and the start time T1j, the end time T2j and the magnitude Aaj of the accent command are calculated, the maximum value POWmax and the minimum value POWmin of the overlapped phrase and accent components PHR, ACC are calculated from the approximation of the pitch contour. Then, the magnitudes of the phrase command and the accent command are modified in such a manner that the difference between the maximum value POWmax and the minimum value POWmin is made substantially the same as the. intonation value set by the user. Accordingly, the problem of the conventional method that the voice pitch becomes extremely high partially because of the word-structure of the input text and therefore the synthesized speech is hard to hear can be overcome, thereby producing the synthesized speech that is easy to hear.

Therefore, the pitch contour can be controlled appropriately with a simple structure, as in the first embodiment. Accordingly, the synthesized speech having natural rhythm can be obtained.

In the second embodiment, the minimum value may be fixed to the base pitch Fmin without performing the calculation of the minimum value. This can reduce the throughput.

In each embodiment, the phrase component and the accent component are calculated by assuming the time at the mora-start position to be 0.15×k moras (see Step ST16 in FIG. 4 and Step ST54 in FIG. 9). Alternatively, instead of using one mora as a unit, more precise unit may be used.

In addition, the component value can be more precise at the mora-center position than at the mora-start position, as is apparent from FIG. 10. Therefore, the mora-center position may be obtained by adding a predetermined value, for example, 0.075 to the mora-start position (0.15×k) and the component value may be obtained by using 0.15×k+0.075.

In each embodiment, the constant value, 0.15 [second/mora] is used as a time of the mora position for obtaining the sum of the phrase components or the overlapped component value. Alternatively, the time of the mora-position may be determined by deriving from the user's set speech rate, instead of the default speech rate.

Moreover, the component value per mora may be calculated in advance and stored in a storage medium, such as a ROM, in the form of a table, instead of being calculated by Expression (2) when the sum of the phrase components is obtained.

The parameter generating method for speech-synthesis-by-rule in each embodiment may be implemented by software with a general-purpose computer. Alternatively, it may be implemented by dedicated hardware (for example, text-to-speech synthesis LSI). Alternatively, the present invention may be implemented by using a recording medium such as a floppy disk or CD-ROM, in which such software is stored and by having the general-purpose computer execute the software, if necessary.

The speech synthesis apparatus according to each of the embodiments of the present invention can be applied to any speech synthesis method that uses text data as input data, as long as the speech synthesis apparatus obtains a given synthesized speech by rules. In addition, the speech synthesis apparatus according to each embodiment may be incorporated as a part of a circuit included in various types of terminal.

Furthermore, the number, the configuration or the like of the dictionary or the circuit constituting the speech synthesis apparatus according to each embodiment are not limited to those described in each embodiment.

In the above, the present invention has been described by reference to the preferred embodiments. However, the scope of the present invention is not limited to that of the preferred embodiments. It would be appreciated by a person having ordinary skill in the art that various modifications can be made to the above-described embodiments. Moreover, it is apparent from the appended claims that embodiments with such modifications are also included in the scope of the present invention.

What is claimed is:

1. A speech synthesis apparatus comprising:

a text analyzer operable to generate a phonetic and prosodic symbol string from character information of an input text;

a word dictionary storing a reading and an accent of a word;

a voice segment dictionary storing a phoneme that is a basic unit of speech;

a parameter generator operable to generate synthesizing parameters including at least a phoneme, a duration of the phoneme and a fundamental frequency for the phonetic and prosodic symbol string, the parameter generator including a calculating means operable to obtain a sum of phrase components and a sum of accent components and to calculate a mora average from the sum of the phrase components and the sum of the accent components, and a determining means operable to determine a base pitch from the mora average; and a waveform generator operable to generate a synthesized waveform by making waveform-overlapping referring to the synthesizing parameters generated by the parameter generator and the voice segment dictionary.

2. A speech synthesis apparatus according to claim 1, wherein the calculating means calculates the mora average based on creation times and magnitudes of the respective phrase commands, start times, end times and magnitudes of the respective accent commands, and the determining means determines the base pitch in such a manner that a value obtained by adding the mora average and the base pitch becomes constant.

3. A speech synthesis apparatus comprising:

a text analyzer operable to generate a phonetic and prosodic symbol string from character information of an input text;

a word dictionary storing a reading and an accent of a word;

a voice segment dictionary storing a phoneme that is a basic unit of speech;

a parameter generator operable to generate synthesizing parameters including at least a phoneme, a duration of the phoneme and a fundamental frequency for the phonetic and prosodic symbol string, the parameter generator including a calculating means operable to overlap a phrase component and an accent component, obtain an approximation of a pitch contour from the overlapped phrase and accent components and calculate at least a maximum value of the approximation of the pitch contour, and a modifying means operable to modify a value of the phrase component and a value of the accent component by using at least the maximum value; and a waveform generator operable to generate a synthesized waveform by making waveform-overlapping referring to the synthesizing parameters generated by the parameter generator and the voice segment dictionary.

4. A speech synthesis apparatus according to claim 3, wherein the calculating means calculates the maximum value and a minimum value of the pitch contour from a creation time and a magnitude of the phrase command and a start time, an end time and a magnitude of the accent command, and the modifying means modifies the magnitude of the phrase component and the magnitude of the accent component in such a manner that a difference between the maximum value and the minimum value is made substantially the same as an intonation value set by a user.

* * * * *